US006202372B1

(12) United States Patent
Powell

(10) Patent No.: US 6,202,372 B1
(45) Date of Patent: Mar. 20, 2001

(54) OFF-RIDGE ROOF VENT

(76) Inventor: Andy L. Powell, P.O. Box 9544, Mobile, AL (US) 36691

( * ) Notice: Subject to any disclaimer, the term of this patent is extended or adjusted under 35 U.S.C. 154(b) by 0 days.

(21) Appl. No.: 09/333,066

(22) Filed: Jun. 14, 1999

(51) Int. Cl.[7] ..... E04B 7/00
(52) U.S. Cl. ..... 52/198; 52/199; 454/365
(58) Field of Search ..... 52/198, 199; 454/365, 454/366, 900

(56) References Cited

U.S. PATENT DOCUMENTS

| | | | | |
|---|---|---|---|---|
| 2,447,472 | * | 8/1948 | Donley . | |
| 2,878,743 | * | 3/1959 | Trunnell . | |
| 4,480,534 | * | 11/1984 | Sloan | 52/199 X |
| 4,625,630 | * | 12/1986 | Carroll et al. . | |
| 5,339,582 | * | 8/1994 | Sells | 52/198 |
| 5,402,611 | * | 4/1995 | Vagedes | 52/198 |
| 5,561,952 | * | 10/1996 | Damron | 52/198 |
| 5,605,022 | * | 2/1997 | Fulton | 52/199 |
| 6,077,159 | * | 6/2000 | Clayton | 52/199 X |

* cited by examiner

*Primary Examiner*—Robert W Gibson, Jr.
(74) *Attorney, Agent, or Firm*—Sheridan Ross P.C.

(57) ABSTRACT

A method and apparatus for providing ventilation to a building structure's roof is provided. The apparatus provides a low profile roof vent having improved resistance to bending and thus increased resistance to damage caused by the wind or other forces. Particularly, the apparatus provides a roof vent having generally I-beam shaped internal bracing in both vertical and horizontal directions. Thus, the apparatus of the present invention provides a roof vent that is highly resistant to failure due to exposure to strong winds. The present apparatus also offers improved air flow through the roof vent. The method of the present invention comprises providing a roof vent having a passageway that includes a front and a rear section. The rear section is in communication with a hole in the roof, while the front section is in communication with an exterior of the structure. A baffle between the hole and the exterior of the structure, along the surface of the roof, prevents water from entering the hole directly. The method further includes providing internal bracing to provide increased resistance to bending and thus increased resistance to damage caused by the wind or other forces applied to the vent.

9 Claims, 2 Drawing Sheets

OFF-RIDGE ROOF VENT

FIELD OF THE INVENTION

The present invention relates to vents for installing in building roofs. In particular, the present invention relates to roof vents featuring improved resistance to failure due to the effects of wind or other external loads.

BACKGROUND OF THE INVENTION

There are various designs in existence for providing ventilation for the areas beneath building roofs. The ventilation of such areas is desirable to reduce the accumulation of heat in the summer, and to reduce the accumulation of moisture during all times of the year. In providing ventilation, it is important to prevent the entry of water into the structure through the vent. Also, it is desirable to prevent debris and small animals from entering the structure through the vent.

Existing off-ridge roof vent designs are available in various configurations. One such design consists of simply a duct having a baffle mechanism over the top to prevent the entry of rain into the structure. A variation of this simple design is the turbine type roof vent, which consists of a rotating element on the exterior of the duct and interior baffles to prevent the entry of water into the building. However, both such designed provide only a limited area through which air and moisture may escape from the structure. Also, such designs typically extend a considerable height from the surface of the roof, making them vulnerable to being knocked from the roof by tree limbs, wires, or simply the wind itself.

Other designs fit more closely to the surface of the roof, and provide a long rectangular opening through which air and moisture may exit the structure. Generally, a slot is cut in the roof that is slightly smaller than the foot print of the vent. The slot then communicates with a passageway that, in profile, is generally in the shape of an inverted J. Thus, the opening of the vent faces down, towards the roofing surface. In this way, water is prevented from entering the structure. Such vents may also be provided with a mesh or screen covering the opening, to prevent the entry of debris or small animals into the structure.

However, existing low profile designs suffer from a number of disadvantages. For example, such designs are vulnerable to damage by wind or by impacts from debris. This is because the relatively large area of the opening is unbraced throughout the center of the vent. As a result, even relatively mild winds are capable of exerting sufficient force to damage the device. Typically, damage from the wind to such vents is in the form of bent or deformed top pieces or hoods. Such damage makes the vent more easily penetrated by rain and debris, because portions of the vent opening are enlarged, and often results in deformation of those portions of the vent that interface with the surface of the roof, thus interfering with the proper sealing of the vent to the roof surface. Damage from debris or from careless workers walking on the roof often occurs as crushed or otherwise inwardly deformed top pieces or hoods. This type of damage impedes the movement of moisture and air through the vent and is unsightly. In addition, existing vents can be deflected by the wind or forces to an extent short of what is required to cause permanent damage to the vent. However, such deflection is undesirable for several reasons. Where the opening of the vent is enlarged, rain may more easily enter the structure through the vent. Where the opening of the vent is made smaller, the movement of air and moisture through the vent is impeded. Also, existing designs have a top piece or hood which offers little clearance between itself and the interior baffle, limiting the amount of air that can move through the slot.

Although the prior art describes designs for providing through-roof ventilation to structures, it would be advantageous to provide a design which provided a vent that resists deflection and bending caused by the wind or other forces. In addition, it would be advantageous to provide such a design which had a low profile, and which offered a relatively unimpeded flow of air and moisture from the area beneath the roofing surface to the outside atmosphere.

SUMMARY OF THE INVENTION

In accordance with the present invention, an apparatus for providing through roof ventilation to a structure is disclosed. In particular, an apparatus for providing ventilation to the attic space of a structure, having improved flow characteristics and improved resistance to damage from wind or from crushing is disclosed. More particularly, the present invention provides an apparatus that resists deflection and bending due to the effects of the wind or other forces. The apparatus generally comprises left and right sidewalls at either end of a hood having a back flange for alignment with the roof's surface, a rear surface rising from the roof, a top, and a header extending from the top towards the roof surface. The header does not extend all the way to the roof surface, but instead forms a gap through which air may pass. The vent further includes a baffle extending from the left sidewall to the right sidewall in a plane that is substantially perpendicular to the plane of the roof. The baffle is coincident with the roof on a first edge, and extends to a line between the sidewalls that is short of the top of the hood, such that a gap between the top of the baffle and the top of the hood is formed. This baffle thus prevents water that enters the vent through the gap between the header and the roof from entering the portion of the vent between the rear surface of the hood and the baffle, where air exits the attic and enters the vent, thus preventing water from entering the interior of the structure.

The roof vent of the present invention provides increased stiffness and resistance to damage from wind or from crushing by providing internal braces. Thus, a hood brace extends from the top of the baffle in a substantially vertical direction to interconnect with the top of the hood. In this way, an I-beam type structure is created inside the roof vent, enabling the roof vent to resist deformation or bending from even strong winds or other forces. More particularly, a structure is formed having the characteristics of two I-beam type structures stacked one on top of the other. In addition, a header brace is provided which extends from the top of the baffle to a distal edge of the header. Furthermore, the header is, when viewed in profile, generally in the shape of an I-beam structure. This provides great resistance to movement in response to bending or torsional forces applied to the header by the wind or other external effects. Where the roof vent is particularly long, a plurality of hood braces and header braces may be provided. In addition, header braces and hood braces need not be used in combination. In addition to the improved resistance to damage from external forces, the roof vent of the present invention provides increased flow volumes by providing a deep (or tall) header. The depth of the header allows more space between the top of the hood and the top of the baffle, without compromising the resistance of the vent to intrusion by water.

In one embodiment, the roof vent of the present invention features screen or wire mesh material between the top of the baffle and the edge of the header. In a preferred embodiment, the screen rests on top of screen support clips also running between the top of the baffle to the edge of the header.

In a preferred embodiment, the top of the baffle includes a forwardly extending rain return portion or shelf. The rain return offers further resistance to intrusion by water into the interior of the structure by forming a more convoluted path between the interior of the structure and the outside atmosphere. In yet another embodiment, the header brace is formed such that it is crimped about an exterior lip of the header, improving the resistance of the hood to damage from wind. In a further embodiment, the hood brace is affixed to the baffle by crimping at a first end, and to the interior surface of the hood by adhesive.

According to one embodiment of the present invention, the roof vent is formed from galvanized steel. In a further preferred embodiment, the hood brace and header brace are formed from 16-gauge galvanized steel, while the sidewalls, hood, and baffle are formed from 26-gauge galvanized steel. In other embodiments, the roof vent may be formed from a variety of materials having a variety of thicknesses. Preferably, the material is resistant to corrosion, so that it is suitable for use on the exterior of a building, and is sufficiently ductile to be formed by crimping and bending.

The roof vent of the present invention may be provided in a wide variety of sizes. For example, the roof vent of the present invention may be provided in sizes ranging from about 2 feet to about 10 feet in length. However, sizes outside of the aforementioned range are encompassed by the present invention. The only constraint on size is the size of the roof to which the vent will be installed. Generally, the volume of the attic to be ventilated determines the size of the vent. Depending on the length of the vent, a varying number of hood braces and header braces may be provided. The number of braces may also be varied according to the desired resistance to damage from wind or crushing. Thus, a roof vent to be installed in a structure that will be subject to high winds may be provided with a greater number of braces to improve the vent's resistance to wind damage.

The vent of the present invention may also be provided with side flanges extending from the sidewalls of the vent. In addition, these side flanges may be provided with water hems. Water hems, which are formed by folding the edge of the flange back on itself almost but slightly less than 180°, prevent water from entering the structure by passing between the top of the side flange and the bottom of roofing material.

Based on the foregoing summary, a number of salient features provided by the present invention may be discerned. The present invention allows a vent that has improved resistance to deformation and permanent damage by wind or by other forces. The vent also offers an improved flow volume, increasing the efficiency with which the area beneath the roof is vented. The invention also provides these benefits while offering improved resistance to intrusion into the structure by rain. In one embodiment, a screen between the baffle and the header prevents debris and small animals from entering the structure through the vent. Preferably, this screen is held in position by clips, facilitating assembly and retaining the resistance of the material to corrosion.

Additional advantages of the present invention will become readily apparent from the following discussion, particularly when taken together with the accompanying drawings.

DETAILED DESCRIPTION

In accordance with the present invention, a roof vent apparatus is provided for ventilating spaces beneath the roofs of building structures.

Figure 1:
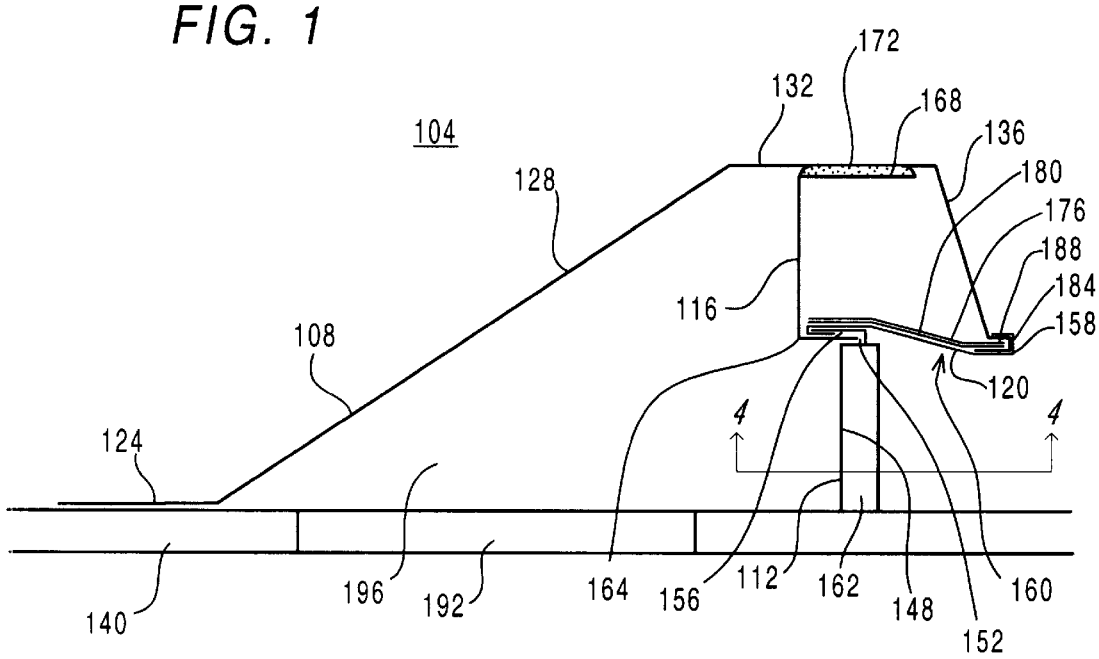
FIG. 1 is a side view of the roof vent of the present invention, with the sidewall removed.

With reference to FIG. 1, the roof vent 104 of the present invention is shown in profile, with the left sidewall removed. In general, the roof vent is comprised of a hood 108 and a baffle 112. In addition, the roof vent 104 includes a hood brace 116 and a header brace 120. The hood 108 generally includes a back flange 124, a rear surface 128, a top 132, and a header 136. The hood 108 generally has a constant cross section across its entire length, and extends without interruption between the left and right sidewalls. Generally, the back flange 124 is parallel to the plane of the roof surface 140.

The baffle 112 generally includes a front flange 144, a riser 148, a rain return 152 and a channel 156. The aforementioned components generally comprise a first I-beam type structure. The front flange 144 is generally parallel to the plane of the roof surface 140. The riser 148 extends from the roofing surface 140 to a height above the roofing surface 140 that is approximately equal to the height of the distal edge 158 of the header 136 above the roof surface 140. Thus, a ventilation outlet 160 is formed between the baffle 112 and the header 136. In addition, the baffle 112 features side rain return tabs 162 at either end.

The hood brace 116 interconnects with the baffle 112 at the channel 156. According to one embodiment of the present invention, the hood brace 116 is secured in the channel 156 by crimping the channel 156 about the forwardly extending lower support 164 of the hood brace 116. In another embodiment, the hood brace 116 is secured to the baffle using adhesive. The hood brace 116 extends from the top of the baffle 112 in a substantially vertical direction, to meet the top 132 of the hood 108. A support surface 168 is formed at the top of the hood brace 116 to provide support for the top 132 of the hood 108. The hood brace 116 and its interconnections to the top 132 of the hood 108 and to the channel 156 of the baffle 112 generally comprises a second I-beam type structure. According to one embodiment of the present invention, the support surface 168 is affixed to the top 132 of the hood 108 using adhesive 172. The width of the hood brace 116 is a fraction of the width of the entire roof vent 104, to avoid unduly limiting the flow of air through the vent 104.

The header brace 120 extends from the top of the baffle 112 in a generally horizontal direction. According to one embodiment, the header brace 120 is joined to the baffle 112 by crimping. According to other embodiments, the header brace 120 may be joined to the baffle 112 by an adhesive, or a combination of adhesive and crimping. Similarly, the interconnection between the header brace 120 and the header 136 may be formed by crimping, adhesive, or a combination of adhesive and crimping. As with the hood brace 116, the header brace 120 is much narrower in width than the width of the roof vent 104 itself, to avoid unduly impeding the flow of air through the vent. The header brace 120 and its interconnections between the baffle 112 and the header 136 generally comprises a third I-beam type structure.

The roof vent 104 may also include a mesh or screen 176 supported at intervals by clips 180. The mesh 176 prevents the entry of debris or small animals through the outlet 160. The size of the mesh 176 or screen may be varied depending on the environment in which the roof vent will be used. The support clips 180 are provided at intervals, to avoid impeding the flow of air through the outlet 160. Preferably, the support clips 176 are sized such that they hold the screen 180 in position using only friction. This avoids destroying the weather resistance of galvanized materials, as would occur with welding, allows the screen 176 to be easily removed for maintenance, and simplifies assembly.

Figure 2:
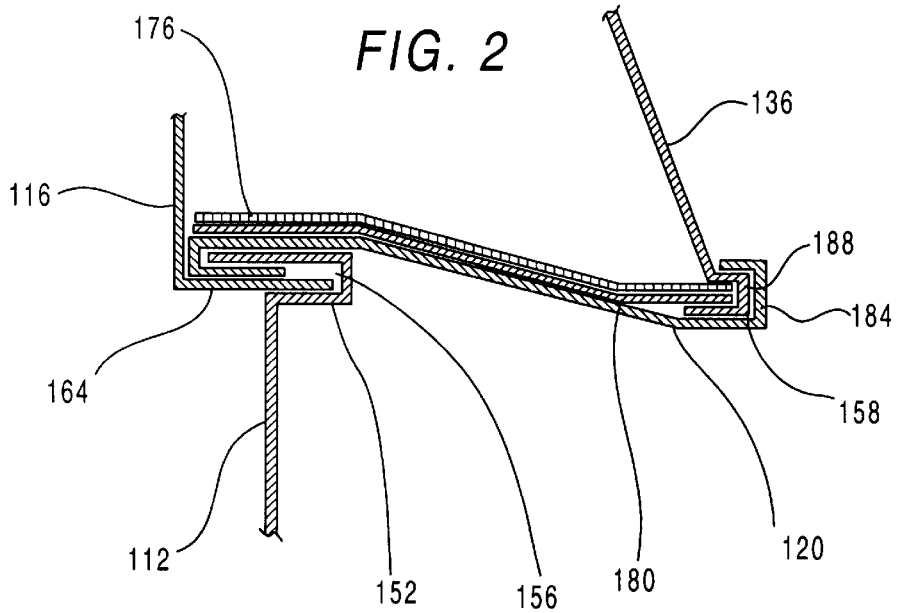
FIG. 2 is a detail of the interconnections between the various components at the top of the baffle and at the distal edge of the header.

Referring now to FIG. 2, a detail of the various interconnections at the top of the baffle 112 and the front edge of the header 136 are illustrated. In particular, it can be seen that baffle 112 makes a 90° turn towards the front of the vent 104 to form the rain return 152. The baffle 112 then turns back on itself, towards the rear of the vent 104 to form channel 156. Channel 156 receives the lower portion 164 of the hood brace 116. In addition, channel 156 receives the rear of the header brace 120. As described above, the hood brace 116 and header brace 120 may be held in channel 156 by the friction caused by the crimp in the baffle 112. Alternatively, the hood brace 116 and header brace 120 may be held in channel 156 using adhesives, adhesive in combination with friction, or by spot welding. In yet another embodiment, the hood brace 116 and header brace 120 may be affixed to the baffle 112 by riveting, or by using threaded fasteners.

Also in FIG. 2, the interconnection between the header brace 120 and the header 136 can be seen. The header brace 120 extends in a generally forward or horizontal direction from the baffle 112 to form a channel 184. Channel 184 extends around channel 188 formed in the distal edge 158 of the header 136. The channel 188 of the header 136 in turn receives the screen clip 180 and the screen 176.

The channel 188, the header 136, and the transition from the header 136 to the top 132 of the hood 108 generally comprises a fourth I-beam type structure.

In one embodiment, the interconnection between the header brace 184 and the header 136 is secured by crimping the header brace 184 about the header 136. As with the interconnection between the baffle 112 the hood brace 116 and the rear portion of the header brace 120, the interconnection between the header brace 184 and the header 136 may be secured using adhesive, a combination of adhesive and friction, or using mechanical fasteners, such as threaded fasteners or rivets.

The screen clip 180 is, in one embodiment, held in position by friction between the header channel 188 and the hood brace 116. Screen clip 180 supports the screen 176. Screen 176 generally comprises a wire mesh or screen sized to prevent the entry of debris and animals into the structure through the roof vent 104. Friction fitting of the screen clip 180 and the screen 176 is preferred because it allows for the easy removal of the screen 176 for cleaning or replacement. However, in other embodiments, the screen clip 180 and screen 176 may be secured to the header 136, header brace 120, baffle 112, or hood brace 116, in various combinations, using adhesives, welds, or mechanical fasteners.

Figure 3:
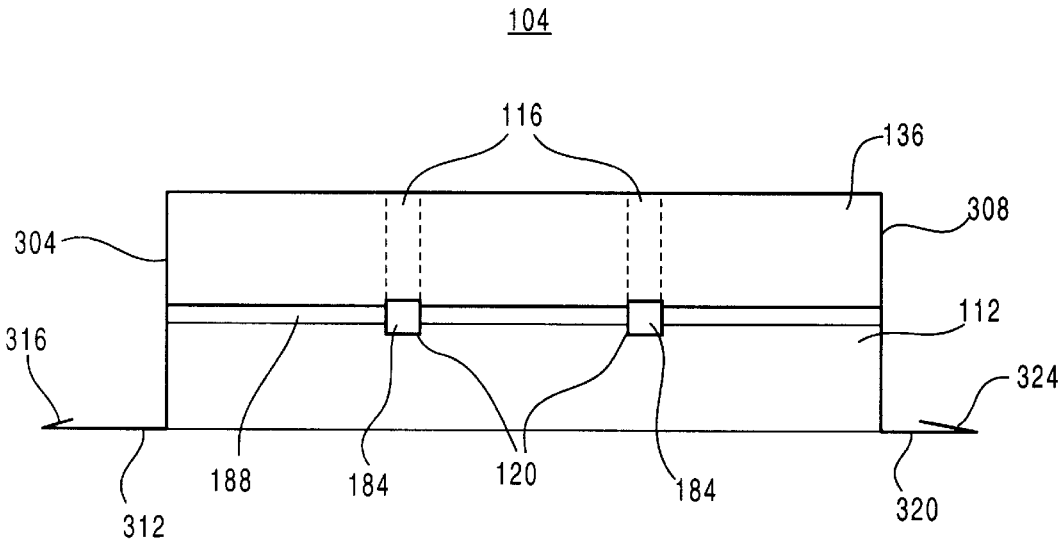
FIG. 3 is a front elevational view of the roof vent of the present invention, showing the hood braces in phantom.

Referring now to FIG. 3, a front elevation of a roof vent 104 according to one embodiment of the present invention is illustrated. The major surfaces illustrated in FIG. 3 are the left side panel 304, the right side panel 308, the header 136, and the baffle 112. Also, the distal edge 158 of the header 136 can be seen.

In the embodiment illustrated in FIG. 3, there are two hood braces 116, illustrated in phantom, and two header braces 120. The hood braces 116 are illustrated in phantom because, in this view, they are obscured by the header 136. Also, with respect to the header braces 120, the specific portion of each brace 120 that is visible is the exterior of the channel 184. Although two hood braces 116 and two header braces 184 are illustrated in FIG. 3, a longer roof vent 104 may feature more such braces 116 and 120, while a shorter roof vent 104 may feature fewer. Additionally, a particular roof vent 104 may have more or fewer braces 116 and 120 depending on the conditions it is expected to encounter when installed, and the desired level of strength.

The view of the roof vent illustrated in FIG. 3 also shows the configuration of the left side flange 312, the left side water hem 316, the right side flange 320 and the right side water hem 324. Generally, the left 312 and right 320 side flanges provide a surface for affixation to the roof surface. Water hems 316 and 324 prevent water from reaching the interior of the structure by passing between the shingles or other roofing material (not shown) of the roof. Instead, water that moves laterally along the side flanges 312 and 320 becomes trapped in the water hems 316 and 324 and is carried to the forward portion of the side flanges 312 and 320, where it can be directed to the outer surface of the roofing material.

Figure 4:
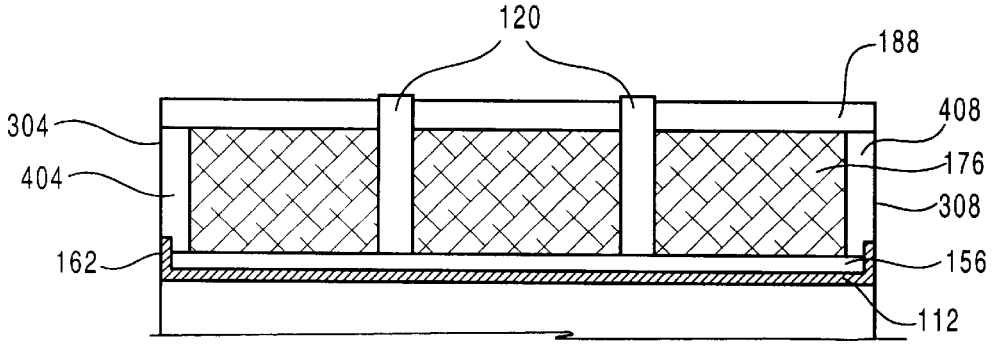
FIG. 4 is a bottom sectional view of the roof vent of the present invention taken along line 4—4 of FIG. 1.

In FIG. 4, a section of a roof vent 104 according to the present invention, taken along line 4—4 in FIG. 1, is illustrated. In FIG. 4, the screen or mesh 176 can clearly be seen. Generally, the mesh 176 has its edges carried by the channel 188 of the header 136, the top of the channel 156 and the baffle 112, and by screen support flanges 404 and 408 formed in the left 304 and right 308 sidewalls of the roof vent 104. The size of the screen or mesh 176 will depend on the area in which the roof vent 104 is installed. Thus, where there are trees in the area that might produce small debris, a smaller hole size in the screen or mesh 176 is called for. Where there is little risk of infiltration by small debris, but small animals are in the area, a larger, sturdier mesh 176 may be desired.

Header braces 120 can be seen to extend from the channel 156 of the baffle 112 to the exterior of the channel 188 of the header 136. In the embodiment illustrated, screen clips 180 (not illustrated) are located immediately above the header braces 120.

FIG. 4 also illustrates the relationship between the side rain return tabs 162 of the baffle 112, and the left 304 and right 308 sidewalls of the roof vent 104. The side rain return tabs 162 extend from the baffle 112 at a 90° angle to the baffle towards the front of the roof vent 104. This allows the side rain return tabs 162 to function as a rain return, and eliminates the need to otherwise seal the interface between the side tabs 162 and the sidewalls 304 and 404 against intrusion by water. In a preferred embodiment, each side rain return tab 162 is affixed to a corresponding sidewall 304 or 308 to further stabilize and stiffen the roof vent 104. Methods for affixing the side rain return tabs 162 to the sidewalls 304 and 308 include adhesives or mechanical fasteners. In a most preferred embodiment, the side rain return tabs 162 are riveted to the sidewalls 304 and 308.

In use, the roof vent 104 is generally positioned above a rectangular hole. Referring again to FIG. 1, a hole 192 is illustrated. The hole 192 is sized in such that it is completely enclosed within the inlet passage-way 196 of the roof vent 104. Thus, the only way for air and moisture to exit the interior of the structure is to travel up through hole 192 and through the passage-way 196. The air may then pass over the baffle 112, around the top braces 116 through the screen 176 and around screen clips 180 and header braces 188, to exit through the outlet 160.

The roof vent 104 is affixed to the roof 140 using adhesives or mechanical fasteners, such as screws, bolts, nails, or staples applied at the back flange 124, front flange 144, left side flange 312 and right side flange 320. Typically, roofing material will be installed over the back 124 and side 312 and 320 flanges to insure that water is not able to infiltrate the structure by leaking beneath the roof. For the same reason, the front flange 144 typically rests on top of the roofing material.

Water is prevented from entering the hole 192 from directly above by the hood 108. The sidewalls 304 and 308 prevent water from entering from the sides. From the front of the roof vent 104, water is prevented from entering by the baffle 112 and the rain return 152, in combination with the header 136. These components form a convoluted path which must be traversed in order for water to enter the structure through the hole 192.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. An off-ridge vent adapted for affixation to a roof surface, comprising:

a left sidewall;

a right sidewall;

a hood interconnected to said left sidewall and said right sidewall, comprising:

a top;

a back flange to align with the roof surface;

a rear surface rising from said roof surface between said back flange and said top; and a header extending from said top in a direction towards said roof surface, wherein a gap is formed between a bottom of said header and the roof surface, and wherein a left side of said hood extends to said left sidewall, and wherein a right side of said hood extends to said right sidewall;

a baffle interconnected to said left sidewall and said right sidewall and extending substantially vertically upward with respect to the roof surface and towards said top of said hood, and extending horizontally from said left sidewall to said right sidewall, wherein a gap is formed between a top of said baffle and said top of said hood;

a hood brace extending substantially vertically from said top of said baffle to interconnect said baffle and said top of said hood; and a header brace extending substantially horizontally from said top of said baffle to interconnect said baffle and said header.

2. The off-ridge roof vent of claim 1, wherein said left sidewall and said right sidewall each have a side flange.

3. The off-ridge roof vent of claim 2, wherein said side flanges each have a water hem.

4. The off-ridge roof vent of claim 1, further comprising a screen extending from said top of said baffle to said header.

5. The off-ridge roof vent of claim 4, further comprising a screen clip extending from said-top of said baffle to said header, wherein a portion of a bottom of said screen rests on a top of said screen clip.

6. The off-ridge roof vent of claim 1, wherein said top of said baffle has a shelf extending towards a distal edge of said header, wherein a gap is formed between a forward edge of said shelf and said distal edge of said header.

7. The off-ridge vent of claim 1, wherein said baffle has left and right side rain return tabs extending towards a front of said roof vent, wherein said side tabs are affixed to said left and said right sidewalls.

8. The off-ridge roof vent of claim 1, wherein said hood is constructed from galvanized steel.

9. A method for ventilating a structure, comprising:

forming a hole in a roof surface;

forming a passageway having a rear section and a front section, wherein said rear section communicates with a hole in the roof and said front section communicates with an exterior of the structure, and wherein said rear section and said front section of said passageway are separated by a baffle;

bracing said passageway in a vertical direction by providing a member in an interior of said passageway that extends from said baffle to a top of said passageway; and bracing said front section of said passageway in a horizontal direction by providing a member extending from said baffle to a distal edge of said forward section.

* * * * *